US005839140A

United States Patent [19]

Wilkerson

[11] Patent Number: 5,839,140

[45] Date of Patent: Nov. 24, 1998

[54] INFLATABLE WHEELCHAIR CUSHION AND METHODS OF MANUFACTURING AND USE

[75] Inventor: Jack Wilkerson, Pleasant Valley, N.Y.

[73] Assignee: Geomarine Systems, Inc., Sanford, Fla.

[21] Appl. No.: 927,555

[22] Filed: Sep. 6, 1997

Related U.S. Application Data

[63] Continuation of Ser. No. 644,640, Apr. 3, 1996, abandoned.

[51] Int. Cl.[6] ..... A47C 1/022

[52] U.S. Cl. ..... 5/654; 5/653; 5/655.3; 5/710

[58] Field of Search ..... 5/654, 653, 710, 5/711, 731, 900.5, 644, 655.3, 655.5; 297/284.6, 452.41

[56] References Cited

U.S. PATENT DOCUMENTS

| | | | |
|---|---|---|---|
| 2,575,764 | 11/1951 | Morner | 154/85 |
| 3,192,540 | 7/1965 | Swank | 5/349 |
| 3,296,635 | 1/1967 | O'Hanlan | 5/348 |
| 3,297,023 | 1/1967 | Foley | 128/33 |
| 3,503,649 | 3/1970 | Johnson | 5/653 |
| 3,653,083 | 4/1972 | Lapidus | 5/348 |
| 3,870,450 | 3/1975 | Graebe | 425/269 |
| 3,982,786 | 9/1976 | Burgin et al. | 297/284 |
| 4,005,236 | 1/1977 | Graebe | 428/72 |
| 4,073,021 | 2/1978 | Carlisle | 5/365 |
| 4,279,044 | 7/1981 | Douglas | 5/453 |
| 4,643,481 | 2/1987 | Saloff et al. | 5/654 |
| 4,646,374 | 3/1987 | Shafer | 5/481 |
| 4,698,864 | 10/1987 | Graebe | 5/441 |
| 4,799,276 | 1/1989 | Kadish | 5/446 |
| 4,852,195 | 8/1989 | Schulman | 5/453 |
| 4,860,397 | 8/1989 | Gusakov | 5/455 |
| 4,864,671 | 9/1989 | Evans | 5/453 |
| 4,930,171 | 6/1990 | Frantz | 5/654 |
| 4,953,913 | 9/1990 | Graebe | 297/459 |
| 5,052,068 | 10/1991 | Graebe | 5/455 |
| 5,111,544 | 5/1992 | Graebe | 5/470 |
| 5,148,563 | 9/1992 | Klearmen et al. | 5/653 |
| 5,152,023 | 10/1992 | Graebe | 5/455 |
| 5,163,196 | 11/1992 | Graebe et al. | 5/654 |
| 5,193,237 | 3/1993 | Holdredge | 5/654 |
| 5,267,365 | 12/1993 | Walter | 5/455 |
| 5,412,822 | 5/1995 | Kelly | 5/654 |
| 7,912,788 | 4/1990 | Lonardo | 5/653 |

OTHER PUBLICATIONS

"Cushioning to Benefit Tissue Viability," by R. H. Gabe. Date unknown, but predates invention.

Various promotional material by ROHO Incorporated. All predate invention.

*Primary Examiner*—Kenneth J. Dorner
*Assistant Examiner*—Fredrick Conley
*Attorney, Agent, or Firm*—John H. Crozier

[57] ABSTRACT

In a preferred embodiment, an inflatable wheelchair cushion, the cushion including: a base member having a shape complementary to that of a sling-type wheelchair seat; a plurality of fluid-fillable cells rising from the base member, top surfaces of the cells, when the cells are filled with fluid to one or more desired pressures, defining a generally flat seating surface; and means to introduce pressurized fluid to the cells or zoned groups of the cells.

25 Claims, 11 Drawing Sheets

INFLATABLE WHEELCHAIR CUSHION AND METHODS OF MANUFACTURING AND USE

This application is a continuation of application Ser. No. 08/644,640, filed Apr. 3, 1996, now abandoned.

BACKGROUND OF THE INVENTION

1. Field of the Invention

The present invention relates to wheelchairs generally and, more particularly, but not by way of limitation, to a novel inflatable wheelchair cushion that is comfortable and economically constructed.

2. Background Art

A wheelchair typically has a sling seat which hangs, in a form approximating a catenary, from parallel rails disposed horizontally as part of the frame of the wheelchair. The seat is commonly constructed from canvas, leather, or a synthetic material. Since the seat must support a person seated thereon, the material of the seat must be strong and, consequently, have a relatively hard surface. This results in an extremely uncomfortable seat, particularly for a person who is confined to a wheelchair for long periods of time, which confinement can contribute to the formation of pressure sores.

A number of cushioning devices have been developed to provide comfort and to help prevent the formation of, and/or relief from, pressure sores. These include foam, jell-foam, and fluid-filled devices. Some of these are expensive to manufacture. Some are very heavy. The more comfortable of some of these devices are pneumatic cushions having a plurality of air-filled cells. The air-filled cells rise from a horizontal base sheet, with a horizontal base member and the tops of the cells forming horizontal surfaces before placement of the cushions on sling seats. When such a cushion is placed on a catenary seat, control of the upper surface of the cushion is lost when the cushion conforms to the seat. To counter the latter problem, an rigid intermediate member is sometimes provided so that the cushion will lie on a flat, horizontal surface. The pneumatic cushions are typically produced in relatively costly dip molding processes.

Accordingly, it is a principal object of the present invention to provide a pneumatic wheelchair cushion that is comfortable and conforms to standard wheelchair sling seats without modification thereof, to maintain proper patient positioning.

It is another object of the invention to provide such a pneumatic cushion that reduces pressure on the portion of a patient's body in contact therewith.

It is an additional object of the invention to provide a pneumatic wheelchair cushion that serves as the seat of a wheelchair.

It is a further object of the invention is to provide such a pneumatic cushion that is economically constructed.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, an inflatable wheelchair cushion, comprising: a base member having a shape complementary to that of a sling-type wheelchair seat; a plurality of fluid-fillable cells rising from said base member, top surfaces of said cells, when said cells are filled with fluid to one or more desired pressures, defining a generally flat seating surface; and means to introduce pressurized fluid to said cells or zoned groups of said cells.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
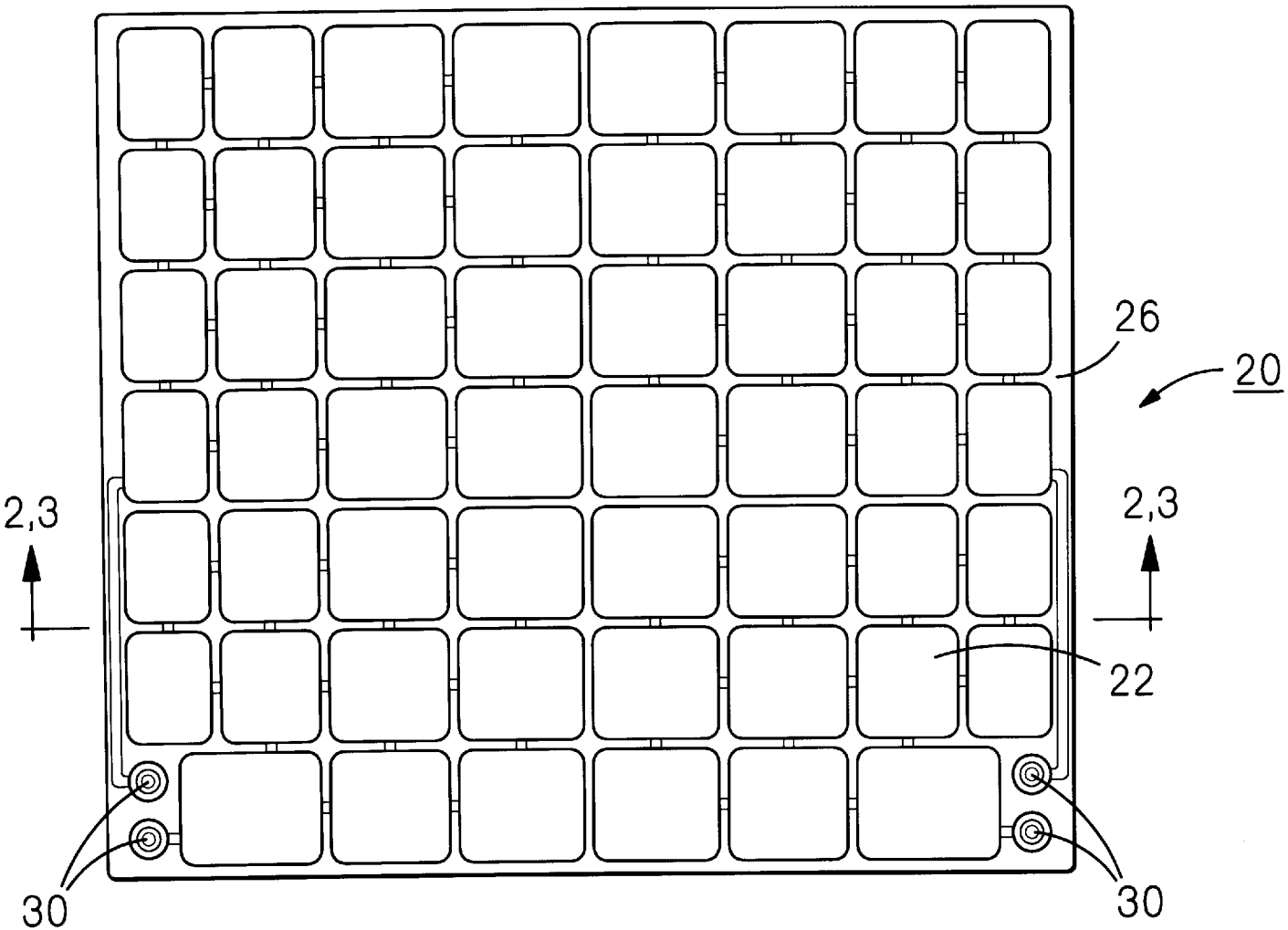
FIG. 1 is a top plan view of an inflatable wheelchair cushion constructed according to the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

Figure 2:
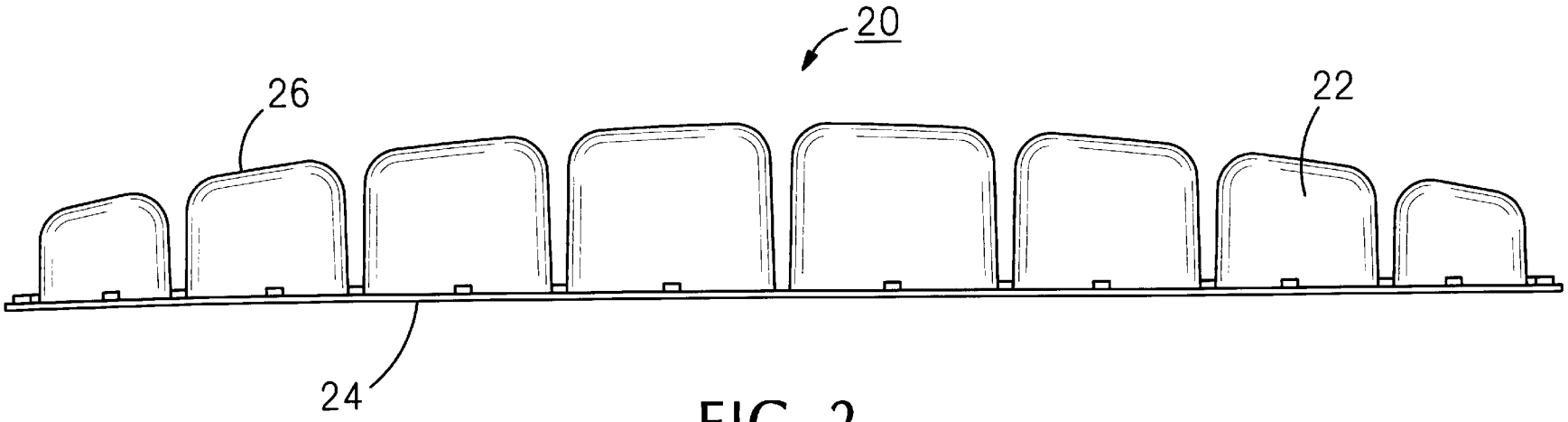
FIG. 2 is a cross-sectional view, taken along line "2,3-2-3" of FIG. 1, showing the cushion as manufactured by one process.

FIGS. 1 and 2 illustrates an inflatable wheelchair cushion, constructed according to the present invention, and generally indicated by the reference numeral 20. Cushion 20 includes a generally rectilinear matrix of fluid-filled cells (FIG. 1), as at 22, rising upwardly (FIG. 2) from a horizontal base member comprising a lower sheet 24 and an upper sheet 26 joined together by RF welding. Cells 22 are preferably vacuum formed in upper sheet 26. Materials for sheets 24 and 26 are preferably polyurethane, RF weldable polypropylene, polyurethane/vinyl blend, or other "soft handed," high compliance material. Lower layer 24 is preferably about 0.040-inch thick and upper layer 26 is preferably about 0.020–0.040-inch thick after forming. So constructed, cushion 20 weighs about two to three pounds. When cells 20 are filled with air at about 24 inches of water pressure, cushion 20 can support the full weight of a 200-pound person.

Referring to FIG. 1, cells 22 are filled with a fluid through one or more valves 30. More than one valve 30 is provided when cells 22 are divided into separate zones. Lower sheet 24 and upper sheet 26 are fully RF welded together around the perimeter of cushion 20 and seams between cells 22 are RF welded except to the extent necessary to interconnect the cells or zones with pressurized fluid from valve(s) 30. Valve(s) 30 can be of the type employed on pneumatic tires or basketballs. The RF welding can be economically accomplished with a flat-faced, two dimensional RF tool having three-dimensional pockets formed therein to accommodate cells 22 during the welding, or sealing, process.

Figure 3:
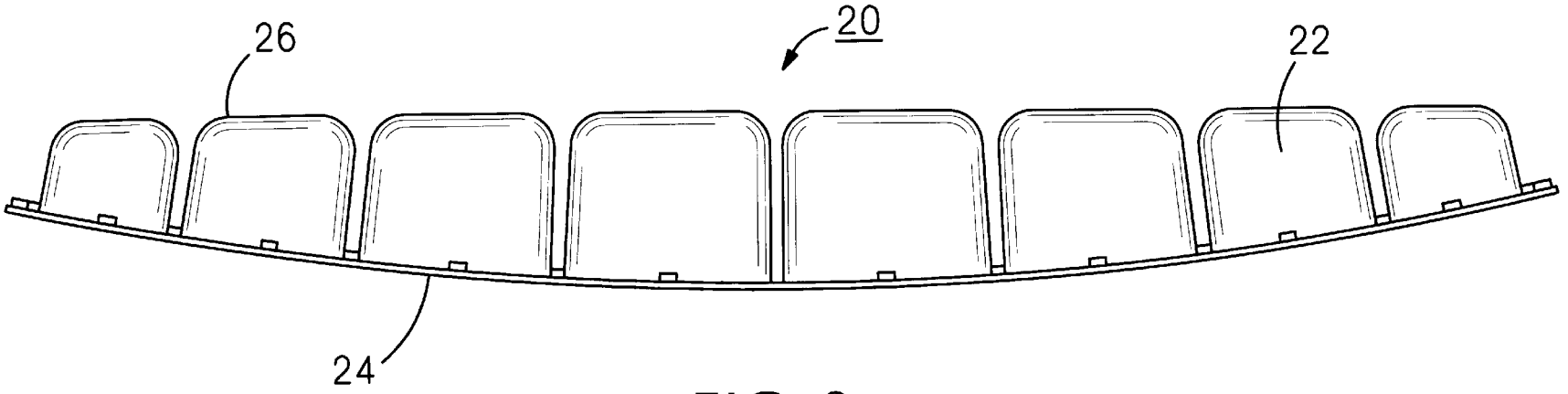
FIG. 3 is a cross-sectional view, taken along line "2,3-2-3" of FIG. 1, showing the cushion in use on a sling type seat/chair base.

FIG. 3 illustrates an important aspect of cushion 20, that is, when the cushion is placed on a sling-type wheelchair seat, its base member formed by lower and upper sheets 24 and 26 assumes a catenary-like shape and the surfaces of the upper ends of cells 22, which were uneven as manufactured (FIG. 2), form a generally flat horizontal surface. This flat top surface prevents pronation of the legs which would cause strain to the body, muscles, and joints of users. This feature also insures reduced skin interface pressure variations to reduce pressure points.

Upper sheet 26 conforms to the shape shown on FIG. 3 when installed on a typical sling type seat/chair base.

Cells 22 are shown as having the upper portions thereof of rectilinear shape. However, the present invention contemplates that cells of other shapes may be employed and, whatever shape cells are employed, they need not be laid out in a rectilinear matrix.

Figure 4:
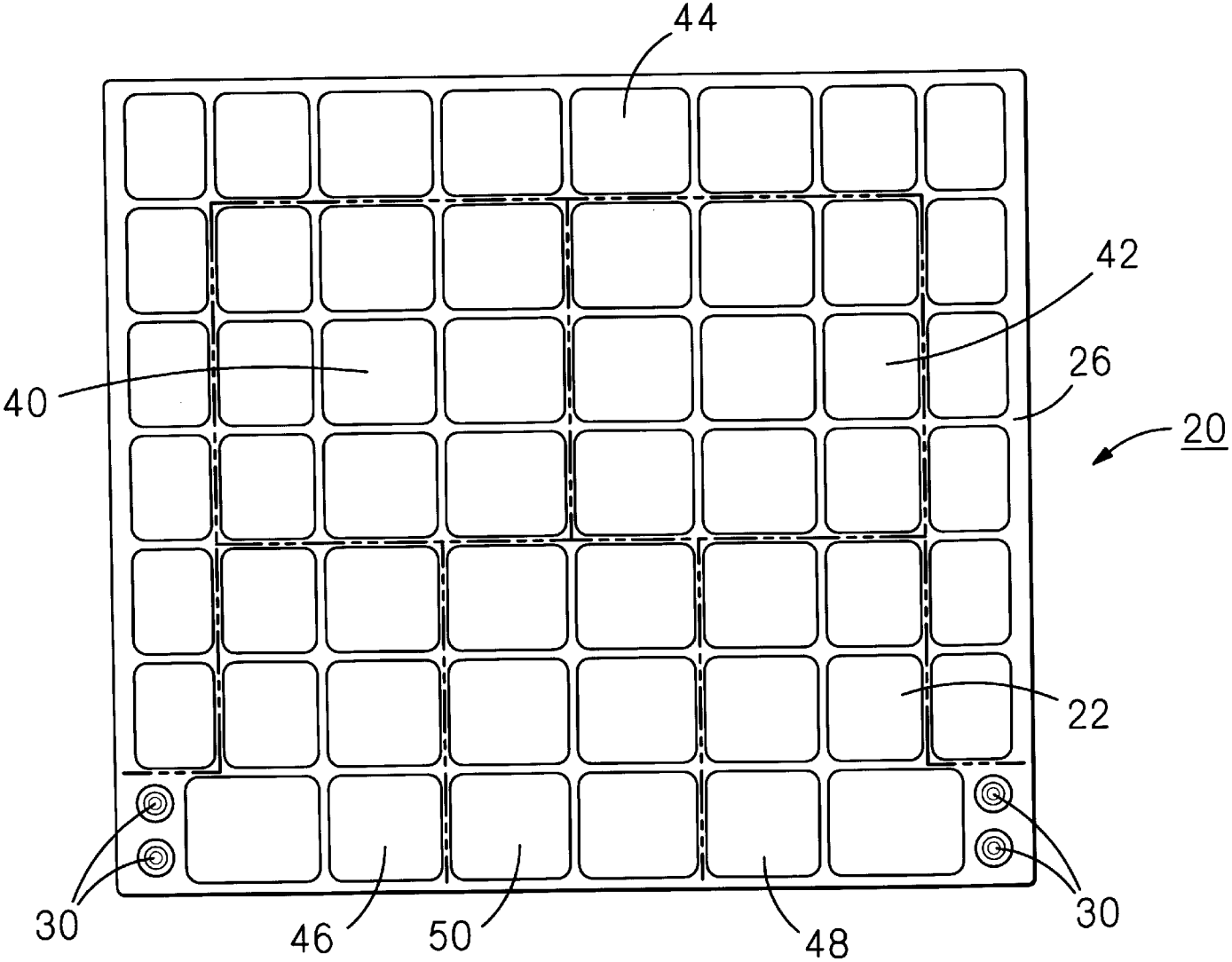
FIGS. 4–7 illustrate the cushion with groups of cells divide into zones.

FIG. 4 illustrates one arrangement of cushion 20 with cells 22 grouped into six zones 40, 42, 44, 46, 48, and 50. Zones 40 and 42 are maintained at an appropriate pressure for comfortable support of the ischial bones, or buttocks of a patient (not shown). Zones 46 and 48, disposed under the thighs of a patient are maintained at pressures independent from zones 40 and 42 so the patient does not pitch (rock) fore and aft. Zones 44 and 50 are maintained at a relatively high pressure, preventing the legs of the patient from pronating. Zone pairs 40/42 and 46/48 are independent to prevent a patient from yawing (rocking) left and right, causing unstable seating and body positioning.

Figure 5:
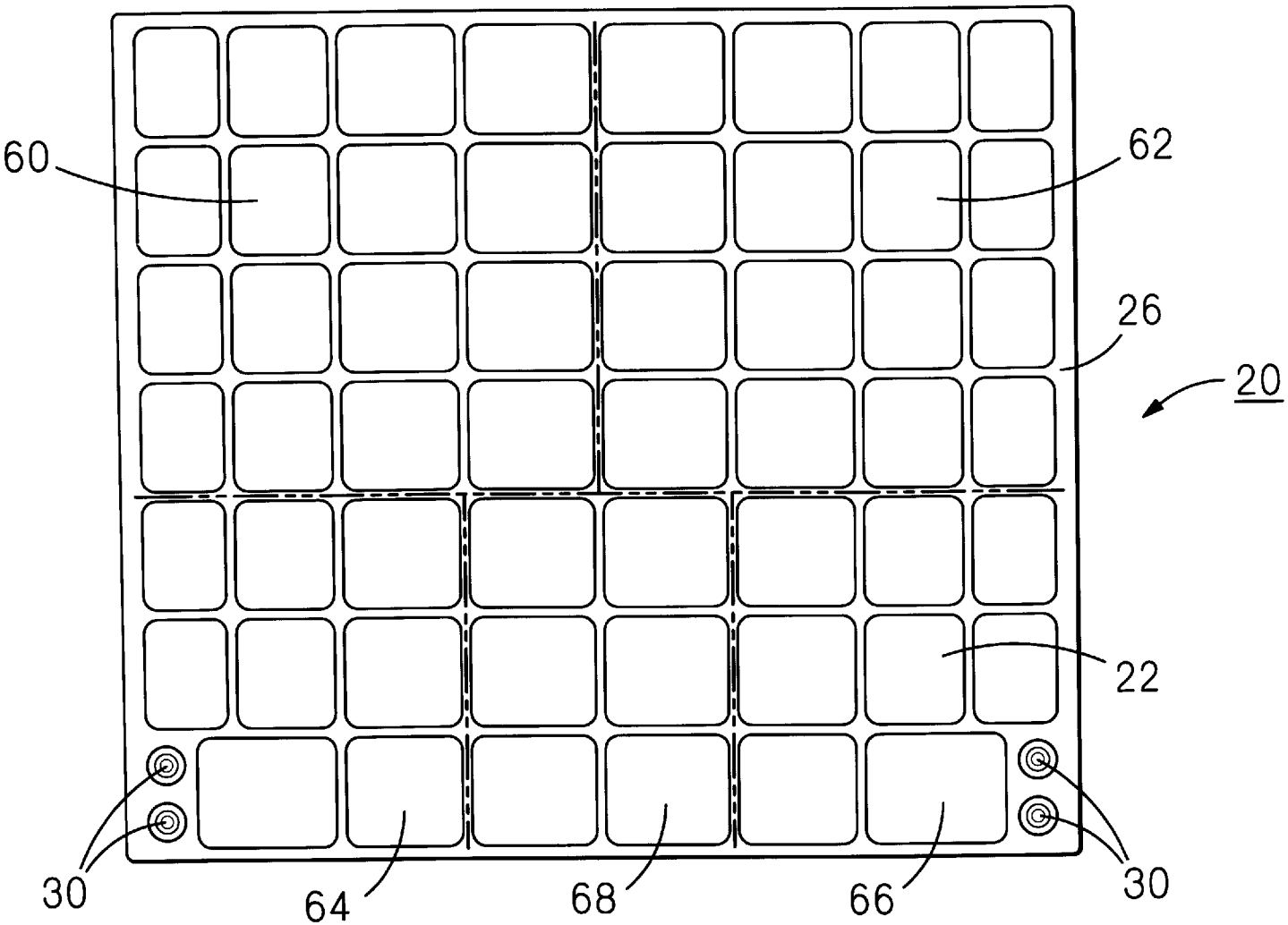

FIG. 5 illustrates a five-zone version of cushion 20 having zones 60, 62, 64, 66, and 68, having the functions, respectively, of zones 40, 42, 46, 48, and 50 on FIG. 4. Zone 68 only prevents pronation together of the legs of a patient, but deformation of cushion 20 when in use tends to prevent pronation outward of the legs. Also, independent deformation of zones 60 and 62 tend to prevent yawing (rocking) left and right. The latter feature is one reason for providing separate zones to cushion the buttocks in this, and other, versions of cushion 20.

Figure 6:
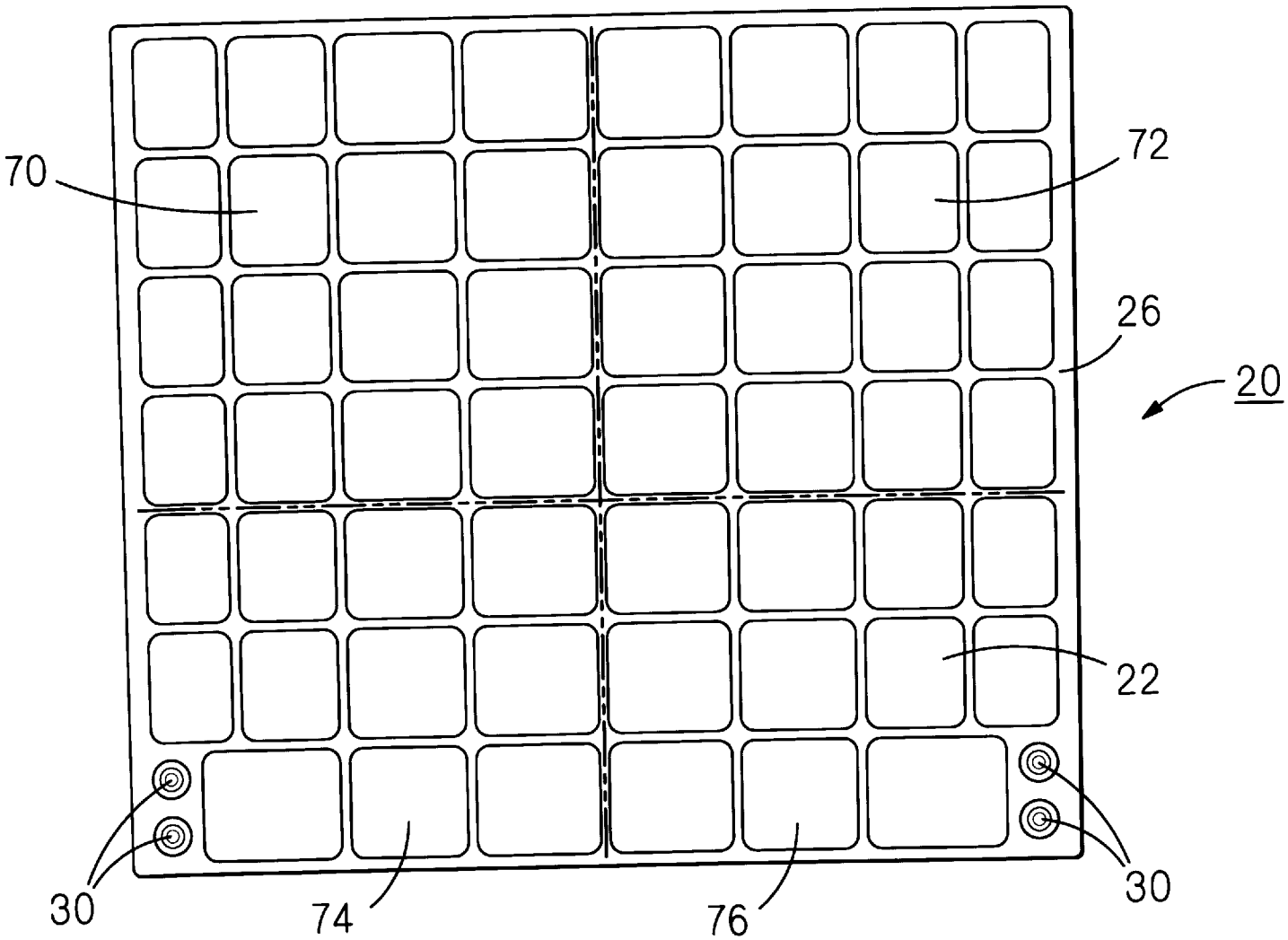

FIG. 6 illustrates a four-zone version of cushion 20 having zones 70, 72, 74, and 76, having the functions, respectively, of zones 60, 62, 64, and 66 on FIG. 5.

Figure 7:
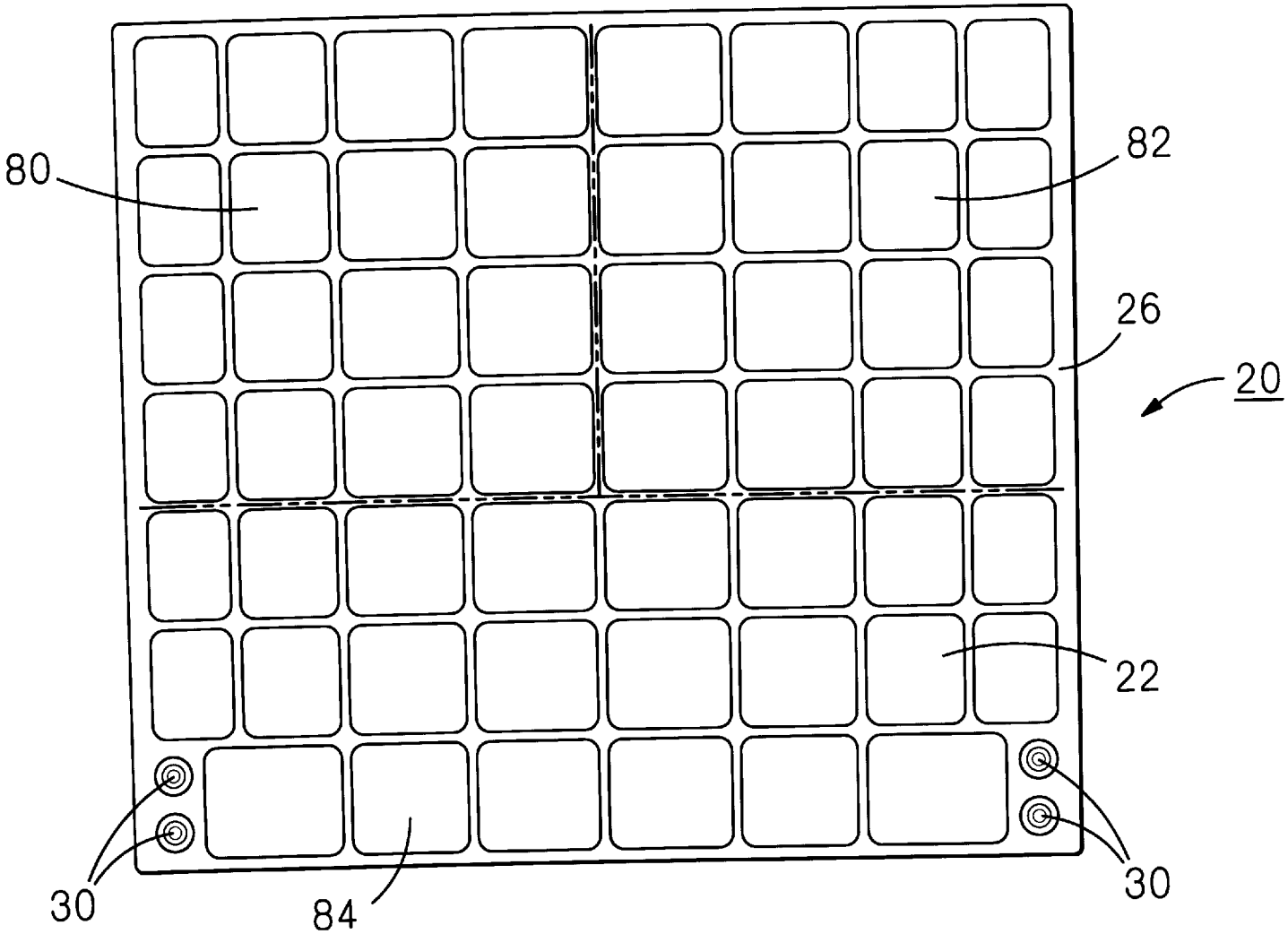

FIG. 7 illustrates a three-zone version of cushion 20 having zones 80, 82, and 84, with zones 80 and 82 having the functions, respectively, of zones 70 and 72 on FIG. 6.

Figure 8:
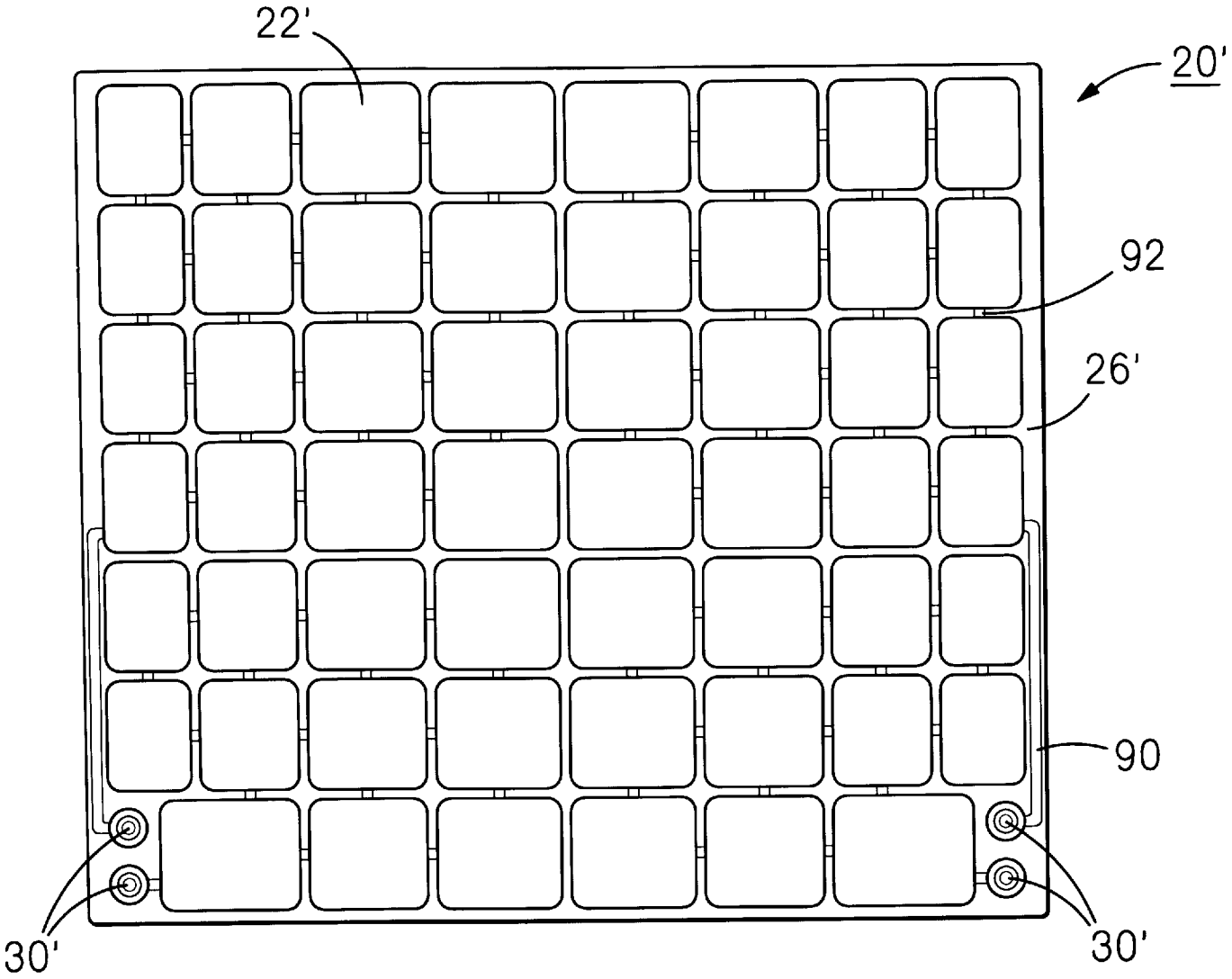
FIG. 8 illustrates another embodiment of an inflatable wheelchair cushion constructed according to the present invention and further illustrating interzone connections.

FIG. 8 illustrates another embodiment of an inflatable wheelchair cushion constructed according to the present invention, generally indicated by the reference numeral 20', showing a more preferred layout of cells 22' and cells for all the embodiments illustrated herein, and showing interconnections (air channels), as at 90 and 92, between valves 30' and the cells to form a four-zone cushion similar to that shown on FIG. 6. Interconnections 90 and 92 are formed in upper vacuum formed layer 26' and only the edges of the interconnections are sealed during the RF welding process.

Figure 9:
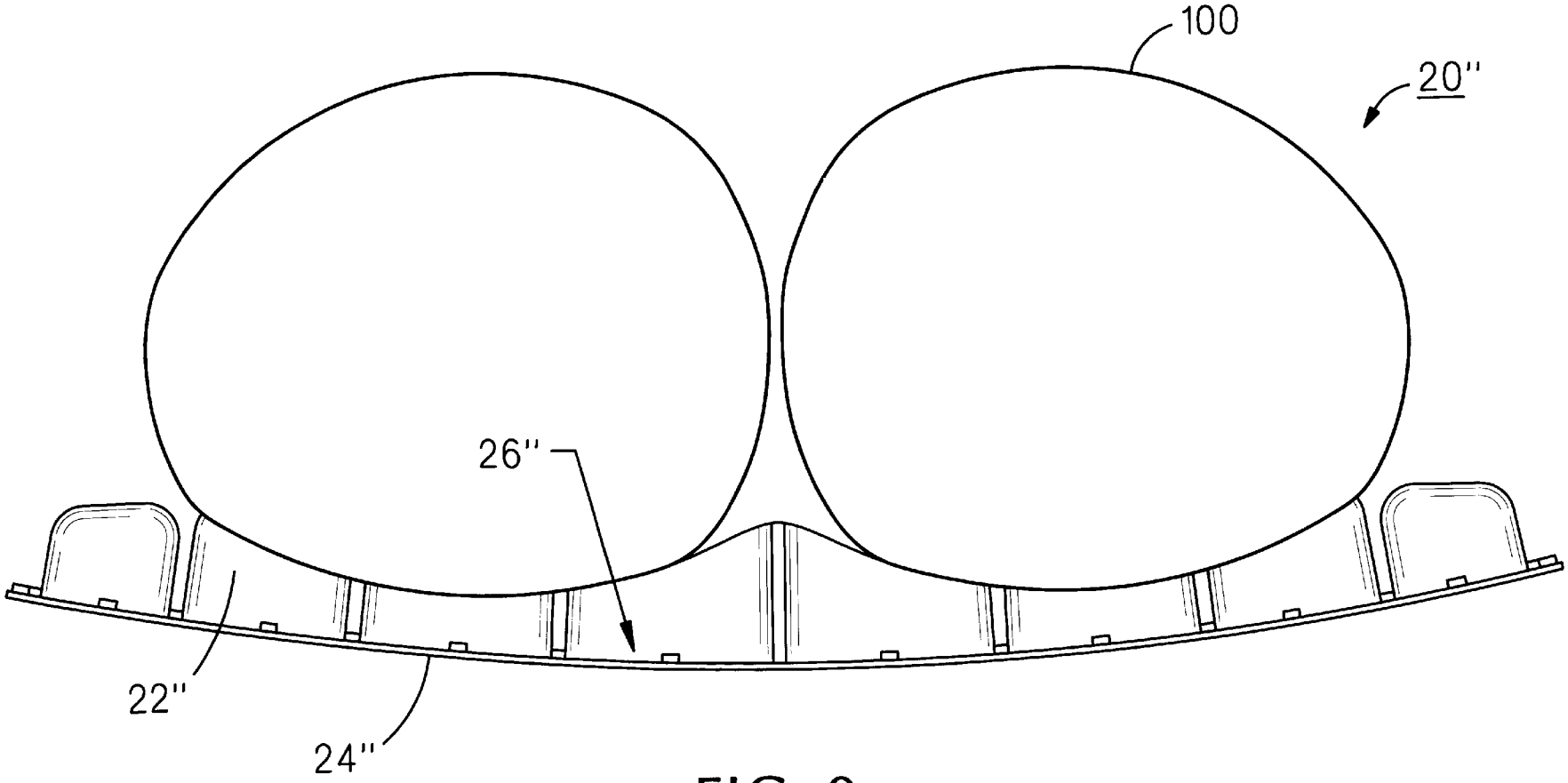
FIG. 9 is a cross-sectional view of a further embodiment of an inflatable wheelchair cushion constructed according to the present invention, showing contouring of the upper surface of the cushion when a person is sitting thereon.

FIG. 9 is a cross-sectional view of a further embodiment of an inflatable wheelchair cushion constructed according to the present invention, generally indicated by the reference numeral 20", and showing a patients thighs 100. As indicated on FIG. 9, the upper surfaces of some of cells 22" are compressed, or hammocked to prevent pronation of the legs/thighs (broken lines) of a patient and provide immersion for maximum pressure reduction. The present invention also contemplates that other zones in this, or other, versions of cushions 20, 20', and/or cushion 20" may also be hammocked or otherwise contoured by the forming/manufacturing tool to reduce excess material folds under the patient.

Figure 10:
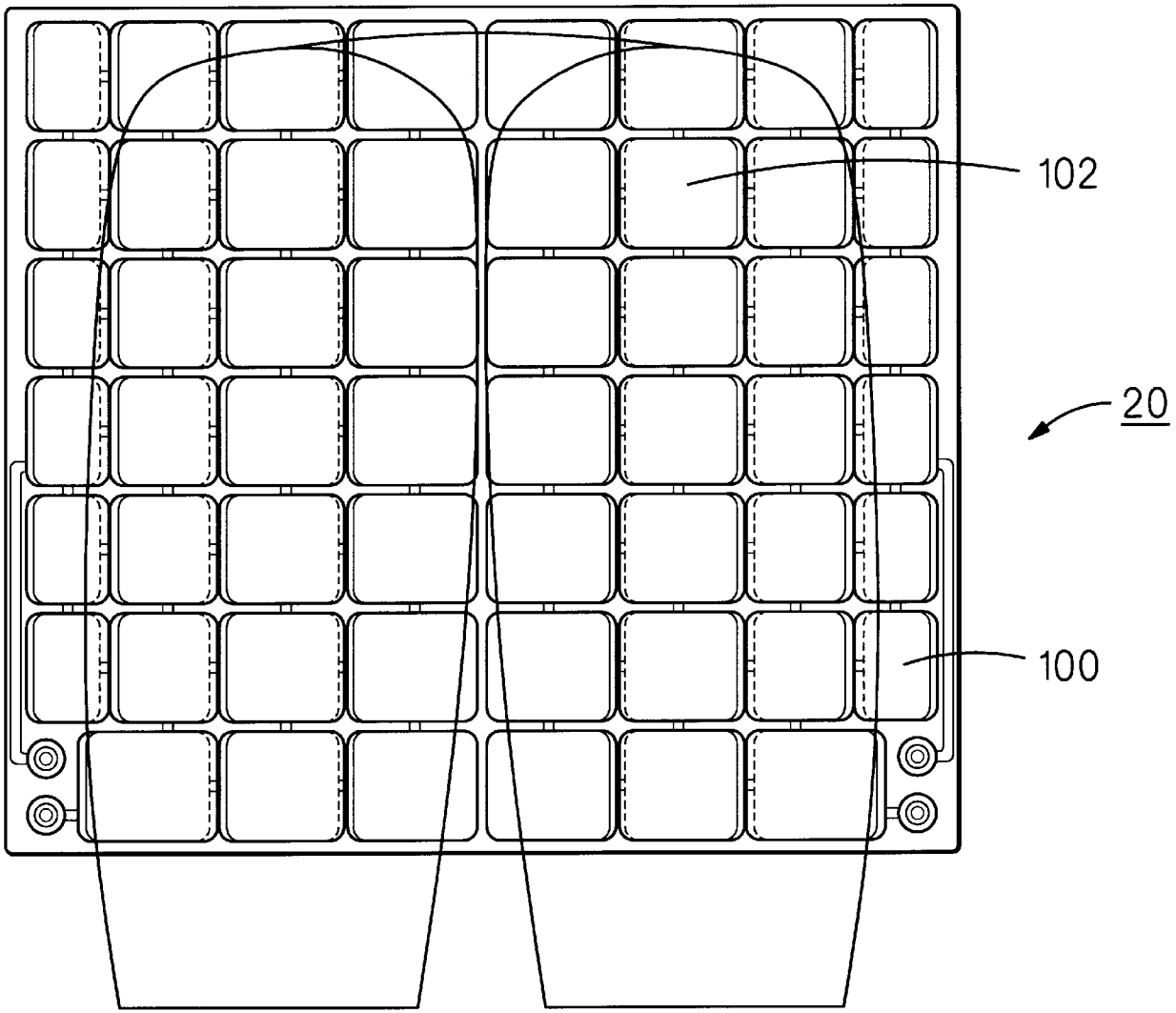
FIG. 10 is top plan view showing the contact area of a person's legs and buttocks.

FIG. 10 illustrates the pressure reducing contact area of a person's buttock 102 and leg/thigh region 100 on cushion 20.

Figure 11:
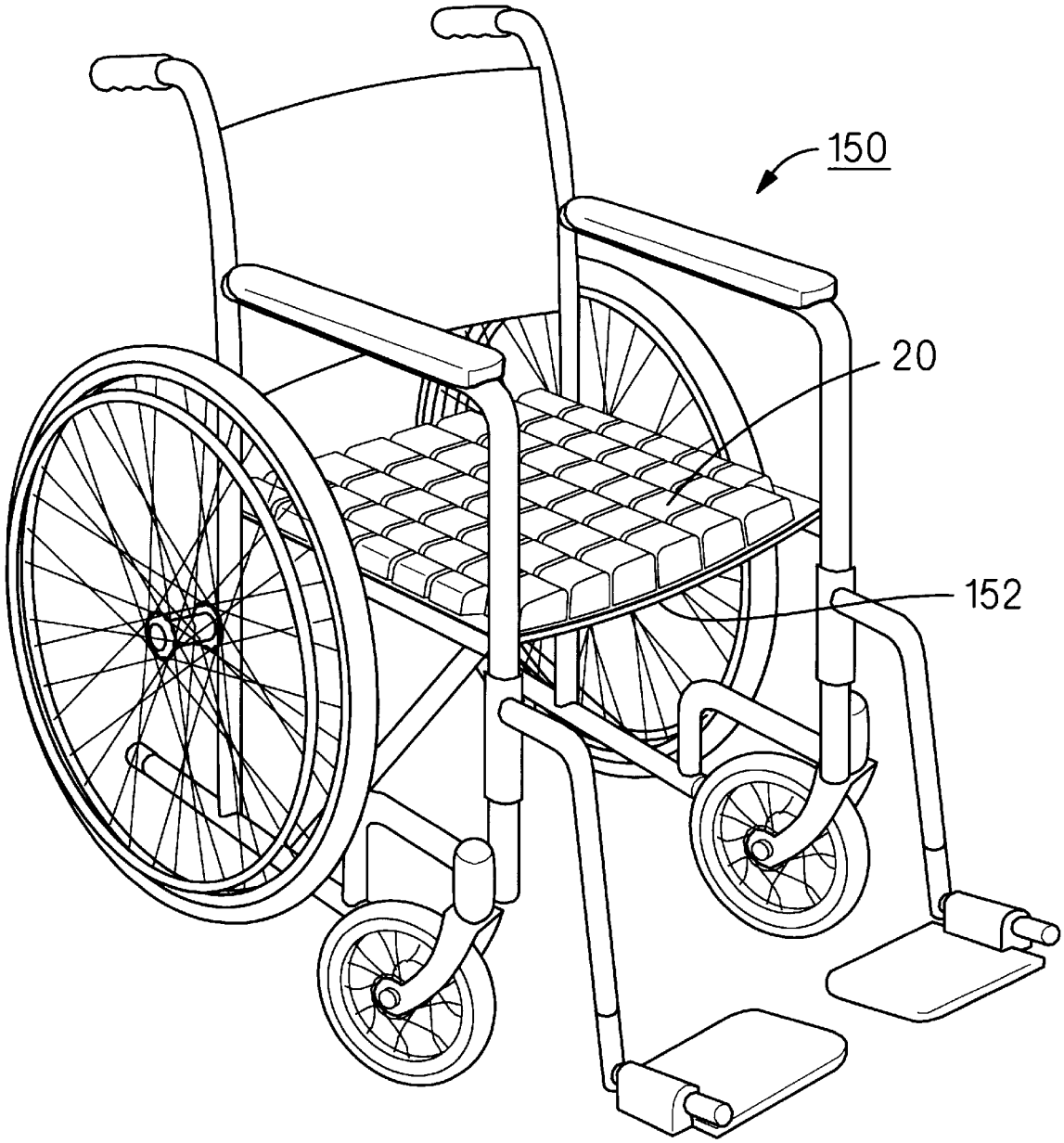
FIG. 11 is an isometric view of the cushion in place on a sling seat of a wheelchair.

FIG. 11 illustrates a wheelchair, generally indicated by the reference numeral 150, with cushion 20 in place on a sling type seat 152.

Figure 12:
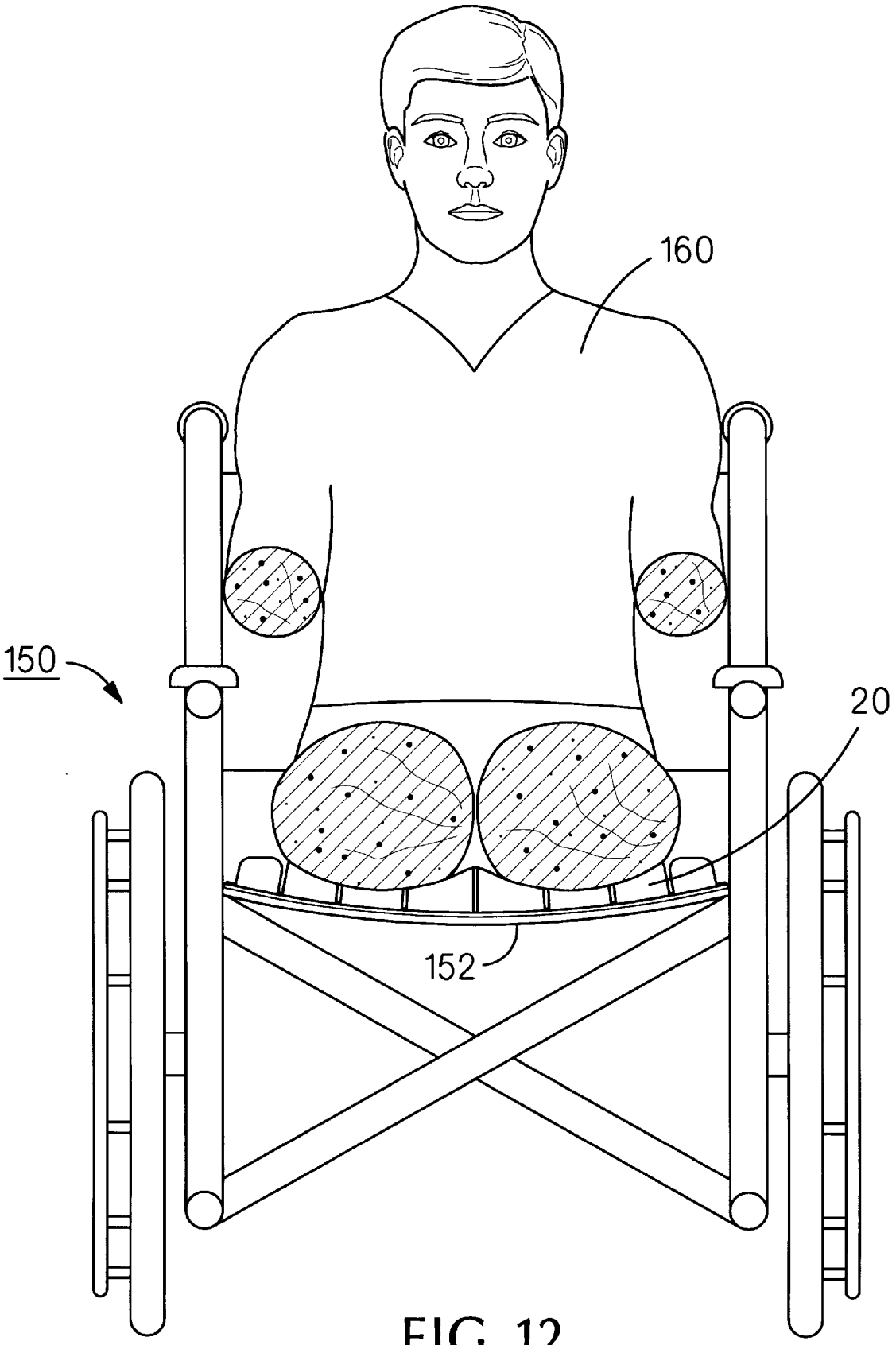
FIG. 12 is a front elevational view, partially in cross-section, of a person seated on the cushion of FIG. 11.

FIG. 12 illustrates wheelchair 150 and cushion 20, with a person 160 seated on the cushion.

The present invention also contemplates that cushion 20 may serve as a permanently or removably attached seat for wheelchair 150. This is accomplished by providing lower sheet 24 (FIG. 3) of sufficient strength to support person 160. All other features of cushion 20, including manufacturing techniques are unchanged. When lower sheet is so used for support, it may also be provided with sufficient flexibility that wheelchair 150 may be folded, with cushion/seat 20 remaining in place.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. An inflatable wheelchair cushion, comprising:

(a) a generally flat, horizontal base member;

(b) a plurality of fluid-fillable cells rising from said base member, top surfaces of said cells, when said cells are filled with fluid to one or more desired pressures, defining a seating surface having a shape generally approximating that of an inverted catenary; and (c) means to introduce pressurized fluid to said cells or groups of said cells.

2. An inflatable wheelchair cushion, as defined in claim 1, wherein said base member comprises:

(a) a lower sheet; and (b) an upper sheet, with said fluid-fillable cells formed therein, attached to said lower sheet.

3. An inflatable wheelchair cushion, as defined in claim 2, wherein said lower and upper sheets are attached together by RF welding.

4. An inflatable wheelchair cushion, as defined in claim 2, wherein: materials of said lower and upper sheets are selected from the group consisting of polyurethane, RF weldable polypropylene, polyurethane/vinyl blend, and other "soft handed," high compliance materials.

5. An inflatable wheelchair cushion, as defined in claim 2, wherein: said lower layer is about 0.040-inch thick and said upper layer is preferably about 0.020–0.040-inch thick after forming.

6. An inflatable wheelchair cushion, as defined in claim 1, wherein: said cushion weighs about two to three pounds.

7. An inflatable wheelchair cushion, as defined in claim 1 wherein: when said cells are filled with air at about 24 inches of water pressure, said cushion can support full weight of a 200-pound person.

8. An inflatable wheelchair cushion, as defined in claim 1, wherein: top surfaces of selected ones of said cells are below said generally flat surface so as to form a contour to support selected body portions of a patient seated on said wheelchair.

9. An inflatable wheelchair cushion, as defined in claim 1, wherein: selected ones of said cells are grouped into at least two zones with each zone individually pressurized with fluid.

10. An inflatable wheelchair cushion, as defined in claim 9, wherein:

(a) said cells along rear and two side edges of said cushion are grouped into a first zone to be maintained at a relatively high pressure to prevent outward pronating of legs of a patient seated on said wheelchair;

(b) said cells in a front center region of said cushion are grouped into a second zone to be maintained at a relatively high pressure to prevent inward pronating of legs of a patient seated on said wheelchair;

(c) said cells in a right rear region of said cushion inside of said first zone are grouped into a third zone and said cells in a left rear region of said cushion inside of said first zone are grouped into a fourth zone, said third and fourth zones to support the buttocks of a patient; and (d) said cells in a right front region of said cushion inside of said first zone are grouped into a fifth zone and said cells in a left front region of said cushion inside of said first zone are grouped into a sixth zone, said fifth and sixth zones to support the thighs of a patient.

11. An inflatable wheelchair cushion, as defined in claim 9, wherein:

(a) said cells in a front center region of said cushion are grouped into a first zone to be maintained at a relatively high pressure to prevent inward pronating of legs of a patient seated on said wheelchair;

(b) said cells in a right rear region of said cushion are grouped into a second zone and said cells in a left rear region of said cushion are grouped into a third zone, said second and third zones to support the buttocks of a patient; and (c) said cells in a right front region of said cushion are grouped into a fourth zone and said cells in a left front region of said cushion are grouped into a fifth zone, said fourth and fifth zones to support the thighs of a patient.

12. An inflatable wheelchair cushion, as defined in claim 9, wherein:

(a) said cells in a right rear region of said cushion are grouped into a first zone and said cells in a left rear region of said cushion are grouped into a second zone, said first second zones to support the buttocks of a patient; and (b) said cells in a right front region of said cushion are grouped into a third zone and said cells in a left front region of said cushion are grouped into a fourth zone, said third and fourth zones to support the thighs of a patient.

13. An inflatable wheelchair cushion, as defined in claim 9, wherein:

(a) said cells in a right rear region of said cushion are grouped into a first zone and said cells in a left rear region of said cushion are grouped into a second zone, said first second zones to support the buttocks of a patient; and (c) said cells in a front region of said cushion are grouped into a third zone to support the thighs of a patient.

14. An inflatable wheelchair cushion, as defined in claim 9, wherein: said cells in a right region of said cushion are grouped into a first zone and said cells in a left region of said cushion are grouped into a second zone, said first and second zones to support the buttocks and legs of a patient.

15. A method of manufacturing an inflatable wheelchair cushion, said method comprising:

(a) providing a generally flat, horizontal lower sheet;

(b) providing an upper sheet having formed therein a plurality of fluid-fillable cells rising from said upper sheet;

(c) joining said lower and upper sheets to form a base member with said plurality of fluid-fillable cells rising from said base member;

(d) providing said base member and said cells such that, said top surfaces of said cells, when said cells are filled with fluid to one or more desired pressures, define a shape generally approximating an inverted catenary.

16. A method, as defined in claim 15, further comprising: vacuum forming said plurality of fluid-fillable cells in said upper sheet.

17. A method, as defined in claim 15, further comprising: attaching said lower and upper sheets together by RF welding.

18. A method, as defined in claim 17, wherein: forming and RF welding of said upper and lower sheets is accomplished on planar surfaces.

19. A method, as defined in claim 15, further comprising: selecting materials of said lower and upper sheets from the group consisting of polyurethane, RF weldable polypropylene, polyurethane/vinyl blend, and other "soft handed," high compliance materials.

20. A wheelchair and wheelchair cushion, comprising:

(a) a wheelchair for supporting a person thereon;

(b) a wheelchair cushion cooperating with said wheelchair to provide comfortable seating for said person, said wheelchair cushion including:

(i) a base member having a shape generally approximating that of a catenary;

(ii) a plurality of fluid-filled cells rising from said base member, top surfaces of said cells defining a generally horizontal seating surface.

21. A wheelchair and wheelchair cushion, as defined in claim 20, wherein: said wheelchair cushion is placed on a sling-type seat member of said wheelchair.

22. A wheelchair and wheelchair cushion, as defined in claim 20, wherein: said wheelchair cushion serves as a seat member of said wheelchair and is attached to frame members thereof.

23. A wheelchair and wheelchair cushion, as defined in claim 22, wherein: said cushion has sufficient flexibility to permit folding of a wheelchair to which said cushion is attached while said cushion is so attached.

24. A method of cushioning a sling-type wheelchair seat, comprising:

(a) providing a cushion, said cushion having a generally flat, horizontal base member with a plurality of fluid-fillable cells rising from said base member;

(b) placing said cushion on said sling-type wheelchair seat, such that said base member assumes a generally catenary shape complementary to that of said sling-type wheelchair seat; and (c) filling said cells with pressurized fluid, such that top surfaces of said cells assume a generally flat, horizontal shape.

25. A method of providing a wheelchair seat, comprising:

(a) providing a cushion, said cushion having a generally flat, horizontal base member with a plurality of fluid-fillable cells rising from said base member;

(b) attaching said cushion to a frame of a wheelchair to serve as the seat therefor, such that said base member assumes a generally catenary shape; and (c) filling said cells with pressurized fluid, such that top surfaces of said cells assume a generally flat, horizontal shape.

* * * * *